United States Patent [19]

Kato et al.

[11] 4,279,646

[45] Jul. 21, 1981

[54] FREE CUTTING STEEL CONTAINING SULFIDE INCLUSION PARTICLES WITH CONTROLLED ASPECT, SIZE AND DISTRIBUTION

[75] Inventors: Tetsuo Kato; Shozo Abeyama, both of Aichi; Atsuyoshi Kimura, Handa; Sadayuki Nakamura, Chita, all of Japan

[73] Assignee: Daido Tokushuko Kabushiki Kaisha, Nagoya, Japan

[21] Appl. No.: 105,222

[22] Filed: Dec. 19, 1979

[30] Foreign Application Priority Data

Dec. 25, 1978 [JP] Japan ..... 53-158714

[51] Int. Cl.[3] ..... C22C 39/14; C22C 39/26

[52] U.S. Cl. ..... 75/123 AA; 75/123 E; 75/123 G; 75/126 L; 75/126 M; 75/126 G; 75/128 P; 75/128 E

[58] Field of Search ..... 75/123 AA, 123 N, 123 L, 75/123 G, 123 E, 126 L, 126 M, 126 P, 128 P, 128 E; 148/12 B

[56] References Cited

U.S. PATENT DOCUMENTS

| | | | |
|---|---|---|---|
| Re. 22,021 | 2/1942 | Morris | 75/123 |
| 2,009,714 | 7/1935 | Palmer | 75/123 |
| 3,169,857 | 2/1965 | Rathke et al. | 75/123 |
| 3,192,039 | 6/1965 | Goda et al. | 75/128 |
| 3,634,074 | 1/1972 | Ito et al. | 75/125 |
| 3,645,722 | 2/1972 | Aulenbach et al. | 75/124 |
| 3,679,400 | 7/1972 | Nachtman | 75/123 AA |
| 3,723,103 | 3/1973 | Kato et al. | 75/129 |
| 3,783,043 | 1/1974 | Almond et al. | 148/156 |
| 3,846,186 | 11/1974 | Tipnis | 148/37 |
| 3,853,544 | 12/1974 | Nishi et al. | 75/125 |
| 3,926,687 | 12/1975 | Gondo et al. | 148/12 B |
| 3,973,950 | 8/1976 | Itoh et al. | 75/123 D |
| 4,032,333 | 6/1977 | Josefsson | 75/124 |
| 4,091,147 | 5/1978 | Kanazawa et al. | 428/683 |
| 4,115,111 | 9/1978 | Itoh et al. | 75/128 P |

FOREIGN PATENT DOCUMENTS 48-40525 12/1973 Japan .

OTHER PUBLICATIONS

Massip et al., Thyssen Tech. Berichte, 10(2), (1978), 26.

*Primary Examiner*—L. Dewayne Rutledge
*Assistant Examiner*—Upendra Roy
*Attorney, Agent, or Firm*—Armstrong, Nikaido, Marmelstein & Kubovcik

[57] ABSTRACT

A free cutting steel for machine structural use containing C up to 0.6%, Si up to 2.0%, Mn up to 2.0%, S 0.04 to 0.4%, Te 0.002 to 0.5% and O 0.0010 0.0300%, the balance being substantially Fe exhibits excellent machinability when the MnS-based inclusion is in the form of particles of 5 to 100μ long, 1 to 10μ wide, wherein the aspect ratio length/width is not larger than 10, and at the density of 20 to 200 particles per 1 $mm^2$ of the matrix cross section.

A free cutting steel for machine structural use containing C up to 0.6%, Si up to 2.0%, Mn up to 2.0%, S 0.04 to 0.4% and Te up to 0.1%, wherein %Te/%S is at least 0.04, O up to 0.003% and N up to 0.0200%, the balance being substantially Fe exhibits improved rolling-contact fatique strength when at least 80% of sulfide-based inclusion particles of 10μ long or more have the aspect ratio length/width of 5 or less, and when areal percentage of alumina cluster in the matrix cross section is not higher than 0.5%.

9 Claims, No Drawings

FREE CUTTING STEEL CONTAINING SULFIDE INCLUSION PARTICLES WITH CONTROLLED ASPECT, SIZE AND DISTRIBUTION

BACKGROUND OF THE INVENTION

1. Field of the Invention

The present invention relates to a free cutting steel for machine structural use having improved properties by containing sulfide inclusion particles with controlled aspect, size and distribution.

One aspect of the present invention concerns a free cutting steel of excellent machinability strengthened by controlling aspect, size and distribution of MnS-based inclusion particles in the steel matrix into limited scopes.

Another aspect of the invention concerns a free cutting steel of a high rolling-contact fatigue strength improved by controling aspect of sulfide inclusion particles in the steel so that the majority of the relatively large particles may not be extremely elongated and by lowering areal percentage of alumina cluaster in the matrix cross section.

The free cutting steel for machine structural use of the present invention covers carbon steel, manganese steel, nickel-chromium steel, chromium- molybdenum steel, mickel-chromium-molybdenum steel, manganese-chromium steel, molybdenum steel and nickel-molybdenum steel.

2. State of the Art

It has been well known that some elements such as sulfur, tellurium and lead are useful for improving machinability of steels, and free cutting steels which have increased machinability by adding one or more of these elements to carbon steel or low alloy steel are widely used.

Demand for better machinability of steel, however, has been not completely satisfied, and various industries have been seeking further improvement in machinability of steel.

The inventors found the fact that steel for machine structural use containing suitable amounts of Te and S exhibits not only increased machinability but also decreased anisotropy in mechanical properties and good formability in cold forging. There has been a need for improvement of rolling-contact fatigue strength of such a kind of free cutting steel.

SUMMARY OF THE INVENTION

An object of the present invention is to provide a free cutting steel for machine structural use, which exhibits excellent machinability beyond usual level.

Another object of the invention is to provide a free cutting steel for machine structural use which exhibits higher rolling-contact fatigue strength.

The above objects can be achieved in accordance with the present invention by controling aspect, size and distribution of particles of sulfide inclusion, particularly MnS-based inclusion in the steel.

DESCRIPTION OF PREFERRED EMBODIMENTS

The free cutting steel of the present invention comprises, basically: C up to 0.6%, Si up to 2.0%, Mn up to 2.0%, S 0.04 to 0.4%, Te 0.002 to 0.50% and O 0.0010 to 0.0300%, the balance being substantially Fe, and contains therein MnS-based inclusion in the form of particles 5 to 100μ long, 1 to 10μ wide, wherein the aspect ratio of length/width of the particles is not larger than 10, at the density of 20 to 200 particles per 1 $mm^2$ of matrix cross section.

The above free cutting steel exhibits, as described below, excellent machinability expressed by 1.5 to 2.0 times or more longer tool life when compared with a conventional free cutting steel of this sort which contains inclusion particles without being controled in characterristics thereof defined above.

The following explains roles of the above noted alloying elements, and significance of the composition and characteristics of the inclusion particles.

C: up to 0.6%

Carbon is essential for assuring strength to the steel for structural use, and is contained in the steel in an amount suitable to the use. Too much content more than 0.6%, however, causes shortened tool life due to too high strength.

Si: up to 2.0%

Silicon is added to steel as a deoxidizing element. It is effective for increasing hardenability and anti-temperability. Because excess amount of Si remarkably damages impact strength, the content should be limited to 2.0% at highest.

Mn: up to 2.0%

Manganese not only promotes hardenability but also is indispensable for formation of Mns-based inclusion which exerts influence on tool lives. Mn should be contained at least in an amount satisfying the ratio Mn/S>2. On the other hand, a content higher than 2.0% affects the tool lives due to excess strengthening of the matrix.

S: 0.04 to 0.40%

Sulfur is of course indispensable for forming MnS-based inclusion, and for this reason, the content should be at least 0.04%. Too much sulfur deteriorates aniostropy in strength and hot workability, and therefore, 0.40% is the upper limit of the content.

Te: 0.002 to 0.50%

Tellurium is essential for the purpose of controling the aspect of MnS-based inclusion which dominates the tool lives. The present steel should contain Te at least 0.002%. Because of significant decrease of hot workability at a higher content of Te, it must not be much more than 0.50%.

O: 0.0010 to 0.0300%

Oxygen also plays an important role of controling the aspect of MnS-based inclusion. The lower limit for this purpose is 0.0010%, and the upper limit is 0.0300%. Excess content will cause decrease of toughness of the steel.

Aspect and distribution of the inclusion particles:

The inventors found that the machinability of the free cutting steel largely depends upon the aspect of particles of non-metallic inclusion, particularly MnS-based inclusion, and conducted a great deal of experiments with various aspects of inclusion particles. As a result, it has been concluded that the most useful aspect and distribution of the inclusion particles for slower progress of tool abrasion are: 5 to 100μ long, 1 to 10μ wide, and the aspect ratio or length/width not larger than 10, and the density of 20 to 200 particles per 1 $mm^2$ of the matrix cross section; and that, if these requirements were not satisfied, the machinability and the strength are dissatisfactory. Thus, the aspect and the distribution of the inclusion particles in the present steel are defined as above.

To the above noted basic composition of the steel, the following alloying elements may be added, if desired:

P: up to 0.10%

Phosphor is favorable for improving smoothness of machine-finished surface, and hence, intended addition thereof is often desirable. In view of embrittlement and, as a result, lowered ductility caused by large quantity of phosphor, the highest content is limited to 0.10%.

Addition of one or more of the following elements in a suitable amount will further improve machinability and/or strength of the steel:

Pb: 0.03 to 0.30%

Lead imparts higher machinability to the steel of the basic composition. So, it is preferable to add Pb in a suitable amount. Effect of the addition will be appreciable at a content of 0.03% or higher. Because the impact strength will be remarkably affected with a large amount of Pb, preferble content is not higher than 0.30%.

Ni: up to 4.5%, Cr: up to 4.5%, Mo: up to 1.0%

These elements are useful for improving hardenability and strength after tempering. The above noted upper limits are decided with a view to avoid decrease of machinability due to increased strength at a higher content of the elements.

The aspect and distribution of inclusion particles giving lengthened tool lives have been found to depend largely upon soaking temperature of ingot and rolling temperature at finishing of hot rolling. From a number of experiments it has been concluded that a soaking temperature between 1200° and 1400° C. and a finishing temperature above 1000° C. will give the inclusion particles of the above defined aspect and distribution.

The free cutting steel of the present invention exhibiting an improved rolling-contact fatigue strength comprises: C up to 0.6%, Si up to 2.0%, Mn up to 2.0%, S 0.04 to 0.40%, Te up to 0.1%, wherein %Te/%S is 0.04 or higher, and O up to 0.0030% and N up to 0.0200%, the balance being substantially Fe, and is characterized in that at least 80% of sulfide-based inclusion particles which are 10μ or more long have the aspect ratio or length/width of 5 or less, and that the areal percentage of alumina cluster in the matrix cross section is not higher than 0.5%.

The free cutting steel also have improved formability in cold forging, which is brought about by addition of Te.

The roles of the above noted components and the significance of the composition are, as far as C, Si, Mn and S are concerned, almost the same as that explained about the free cutting steel of the present invention exhibiting the excellent machinability.

The following describes the other components:

Te: up to 0.10%

In a free cutting steel containing 0.04 to 0.40% of sulfur, it is necessary to adjust %Te/%S to a value not less than 0.04, preferably much more, for the purpose of preventing undesirable elongation of sulfide inclusion such as MnS. However, Te of too high content, like sulfur, damages hot formability with little more improvement in formability in cold forging and rolling-contact fatigue strength. Thus, the upper limit is set at 0.10%.

O: up to 0.0030%

From a view point of rolling-contact fatigue strength, oxygen is a harmful element because it forms oxides which are the cause of cracking. In order that Te may fully influence favorably on rolling-contact fatigue strength, oxygen content should be limited to be 0.0030% or less. Particularly good rolling-contact fatigue strength can be realized with an oxygen content not higher than 0.002%.

N: up to 0.0200%

Nitrogen imparts the steel high deformation resistance and low machinability and formability in cold forging. So, the content should be as low as possible. The upper limit is 0.02%.

The free cutting steel with high rolling-contact fatigue strength may contain, if desired, one or more of the following alloying elements in an amount mentioned below:

P: up to 0.1%,

Pb: up to 0.3%, Bi: up to 0.3%, provided that Pb+Si does not exceed 0.4%,

Se: up to 0.4%, provided that S+Se does not exceed 0.4%, and

Ca: up to 0.0100%

The above listed elements improves the machinability when added to the steel. The upper limits are determined with a view to avoid elongation of sulfide inclusion particles in the steel and to maintain good rolling-contact fatigue strength. If Pb and Bi or S and Se are added together, total amount thereof should not exceed 0.4% so that the hot workability and the rolling-contact fatigue strength may not be affected.

Ni: up to 6.0%, Cr: up to 4.0%, Mo: up to 2.0%

These three elements are essential for the present steel if toughness and anti-temperability are required. At a higher content, however, the effects thereof are not proportional to increase of the content, and therefore, one or more may be added in an amount in the limits mentioned above.

Al: up to 2.0%, B: up to 0.010%, V: up to 0.5%,

Ti: up to 0.5%, Nb: up to 0.5%, Ta: up to 0.5%,

Zr: up to 0.5%, REM (rare earth metal): up to 0.1% in total

It is preferable to add one or more of the selected elements from the group mentioned above, because they improve crystal structure of the steel and heat-treatment properties. In order that the present steel may retain the favorable aspect of the sulfide inclusion particles, and excellent machinability and rolling-contact fatigue strength, addition amount of these elements must be shosen in the given scope.

EXAMPLE I

Materials were melted in an electric furnace with basic lining to produce free cutting steels of the compositions shown in Table I. The steels are classified as follows, and the numbers of JISs defining compositions are as given below:

| Run Nos. | Steel Marks | JIS Numbers |
|---|---|---|
| 1 through 4 | Low carbon | G 4051 |
| 5 through 8 | Medium carbon | G 4051 |
| 9 through 12 | SCr21 | G 4104 |
| 13 through 16 | SCM21 | G 4105 |
| 17 through 20 | SNCM5 | G 4103 |

Ingots of run numbers 1, 3, 5, 7, 9, 11, 13, 15, 17, and 19, or odd numbers, were soaked at 1200° C. to 1400° C., and then hot rolled to give billets of diameter 90 cm. The hot working was conducted with a finishing temperature above 1000° C.

On the other hand, ingots of run numbers 2, 4, 6, 8, 10, 12, 14, 16, 18 and 20, or even numbers, were hot rolled to give billets of the same size as the above billets under usual conditions, i.e. soaking temperature of 1100° to 1300° C., and finishing rolling temperature of 900° to 1000° C.

Accordingly, the runs of the odd numbers are the working examples according to the present invention, and the runs of the even numbers are the control examples according to the conventional hot working method. The conditions of the hot working are shown in Table II.

Specimens for microscopic analysis were taken from the above mentioned billets, and the aspect and distribution of the MnS-based inclusion particles were recorded. The records are as shown in Table III. In Table III the abbreviation "L/W" means average length/width or the aspect ratio of the inclusion particles.

TABLE I

| Steel Mark | Run | C | Si | Mn | P | S | Te | O | Pb | Others |
|---|---|---|---|---|---|---|---|---|---|---|
| Low Carbon | | | | | | | | | | |
| | 1 | 0.08 | 0.02 | 1.25 | 0.061 | 0.275 | 0.04 | 0.0115 | | |
| | 2 | 0.10 | 0.02 | 1.30 | 0.059 | 0.283 | 0.03 | 0.034 | | |
| | 3 | 0.08 | 0.02 | 1.23 | 0.060 | 0.285 | 0.04 | 0.010 | 0.18 | |
| | 4 | 0.10 | 0.02 | 1.28 | 0.063 | 0.278 | 0.04 | 0.032 | 0.19 | |
| Medium Carbon | | | | | | | | | | |
| | 5 | 0.48 | 0.27 | 0.79 | 0.010 | 0.045 | 0.02 | 0.0031 | | |
| | 6 | 0.50 | 0.28 | 0.79 | 0.009 | 0.051 | 0.02 | 0.0032 | | |
| | 7 | 0.48 | 0.25 | 0.81 | 0.013 | 0.055 | 0.02 | 0.0043 | 0.18 | |
| | 8 | 0.50 | 0.26 | 0.78 | 0.010 | 0.050 | 0.03 | 0.0020 | 0.18 | |
| SCr21 | | | | | | | | | | |
| | 9 | 0.14 | 0.25 | 0.73 | 0.012 | 0.055 | 0.02 | 0.0082 | | Cr:1.12 |
| | 10 | 0.14 | 0.25 | 0.73 | 0.013 | 0.053 | 0.02 | 0.0090 | | Cr:1.11 |
| | 11 | 0.13 | 0.24 | 0.75 | 0.011 | 0.045 | 0.02 | 0.0073 | 0.13 | Cr:1.21 |
| | 12 | 0.13 | 0.23 | 0.75 | 0.011 | 0.055 | 0.05 | 0.0081 | 0.13 | Cr:1.15 |
| SCM21 | | | | | | | | | | Cr:1.10 |
| | 13 | 0.15 | 0.25 | 0.68 | 0.008 | 0.048 | 0.02 | 0.0085 | | Mo:0.20 |
| | | | | | | | | | | Cr:1.21 |
| | 14 | 0.15 | 0.26 | 0.62 | 0.009 | 0.050 | 0.02 | 0.0081 | | Mo:0.21 |
| | | | | | | | | | | Cr:1.15 |
| | 15 | 0.14 | 0.22 | 0.70 | 0.007 | 0.070 | 0.02 | 0.0075 | 0.10 | Mo:0.23 |
| | | | | | | | | | | Cr:1.22 |
| | 16 | 0.17 | 0.27 | 0.65 | 0.005 | 0.068 | 0.02 | 0.0073 | 0.08 | Mo:0.19 |
| SNCM5 | | | | | | | | | | Cr:2.75 |
| | 17 | 0.34 | 0.25 | 0.40 | 0.010 | 0.061 | 0.02 | 0.0048 | | Ni:3.35 |
| | | | | | | | | | | Mo:0.63 |
| | | | | | | | | | | Cr:2.96 |
| | 18 | 0.33 | 0.27 | 0.47 | 0.010 | 0.056 | 0.02 | 0.0045 | | ni:3.25 |
| | | | | | | | | | | Mo:0.58 |
| | | | | | | | | | | Cr:2.81 |
| | 19 | 0.35 | 0.23 | 0.45 | 0.010 | 0.058 | 0.02 | 0.0051 | 0.12 | Ni:3.18 |
| | | | | | | | | | | Mo:0.62 |
| | | | | | | | | | | Cr:2.88 |
| | 20 | 0.34 | 0.26 | 0.46 | 0.011 | 0.048 | 0.02 | 0.0042 | 0.10 | Ni:3.30 |
| | | | | | | | | | | Mo:0.55 |

TABLE II

| Steel Mark | Run | Hot Rolling Condition: Soaking Temp. (°C.) | Hot Rolling Condition: Finishing Temp. (°C.) |
|---|---|---|---|
| Low Carbon | | | |
| | 1 | 1,350 | 1,030 |
| | 2 | 1,250 | 950 |
| | 3 | 1,380 | 1,050 |
| | 4 | 1,280 | 980 |
| Medium Carbon | | | |
| | 5 | 1,250 | 1,000 |
| | 6 | 1,250 | 950 |
| | 7 | 1,250 | 1,000 |

TABLE II-continued

| Steel Mark | Run | Hot Rolling Condition: Soaking Temp. (°C.) | Hot Rolling Condition: Finishing Temp. (°C.) |
|---|---|---|---|
| | 8 | 1,250 | 950 |
| SCr21 | | | |
| | 9 | 1,250 | 1,000 |
| | 10 | 1,250 | 970 |
| | 11 | 1,250 | 1,010 |
| | 12 | 1,250 | 980 |
| SCM21 | | | |
| | 13 | 1,250 | 1,010 |
| | 14 | 1,250 | 980 |
| | 15 | 1,200 | 1,020 |
| | 16 | 1,250 | 980 |
| SNCM5 | | | |
| | 17 | 1,250 | 1,010 |
| | 18 | 1,250 | 980 |
| | 19 | 1,250 | 1,000 |
| | 20 | 1,250 | 980 |

TABLE III

| Steel Mark | Run | MnS-based inclusion particles: Average Length(μ) | Average Width(μ) | Average L/W | Average Number/mm$^2$ |
|---|---|---|---|---|---|
| Low Carbon | 1 | 12.5 | 5.5 | 2.3 | 98 |
| | 2 | 27.3 | 0.9 | 30.3 | 203 |
| | 3 | 7.5 | 4.8 | 1.6 | 150 |
| | 4 | 25.4 | 0.7 | 36.3 | 210 |
| Medium Carbon | 5 | 1.5 | 1.5 | 3.7 | 190 |
| | 6 | 8.3 | 0.8 | 10.3 | 740 |
| | 7 | 5.3 | 1.6 | 3.3 | 182 |
| | 8 | 7.5 | 0.7 | 10.7 | 832 |
| SCr21 | 9 | 14.2 | 3.8 | 3.7 | 52 |
| | 10 | 18.4 | 1.1 | 16.7 | 73 |

TABLE III-continued

| Steel Mark | Run | MnS-based inclusion particles Average Length(μ) | Average Width(μ) | Average L/W | Average Number/ mm² |
|---|---|---|---|---|---|
| | 11 | 15.8 | 2.5 | 6.3 | 45 |
| | 12 | 21.3 | 1.3 | 16.4 | 78 |
| SCM21 | | | | | |
| | 13 | 19.0 | 4.9 | 3.9 | 35 |
| | 14 | 73.1 | 1.8 | 40.6 | 72 |
| | 15 | 15.8 | 3.4 | 4.6 | 40 |
| | 16 | 58.2 | 1.3 | 44.8 | 105 |
| SNCM5 | | | | | |
| | 17 | 15.8 | 4.0 | 4.0 | 35 |
| | 18 | 53.0 | 1.9 | 27.9 | 53 |
| | 19 | 12.1 | 6.2 | 2.0 | 28 |
| | 20 | 35.0 | 2.0 | 17.5 | 40 |

As seen from Table III, MnS-based inclusion particles of the control examples, namely, the runs of even numbers, have elongated aspect or higher L/W ratio and larger numbers found in the matrix unit cross section in comparison with the working examples, namely, the runs of odd numbers of the same chemical composition.

The above specimens were, after being normalized for regulation of hardness, subjected to machining tests by drilling and turning under the conditions given below.

Tool life test with HSS twist drill

Drill: SKH9, diameter 10 mm
Feed: 0.42 mm/rev.
Drilling Speed: 47 mm/min.
Depth of Hole: 30 mm (blind hole)
Cutting Oil: none
Criterion of Life: Total numbers of holes until the drill cuts no longer (average, n=10)

Tool life test with carbide single point tool

Tool: P10 (−5, −5, 5, 5, 30, 0, 0.4)
Feed: 0.20 mm/rev.
Cutting Speed: 150 mm/min.
Depth of Cutting: 2.0 mm
Cutting Oil: none
Criterion of Life:
Total length of time until VB=0.2 mm (average, n=10)

The results are shown in Table IV together with the normalizing conditions.

TABLE IV

| Steel Mark | Run | Normalizing Condition | Hardness (HB) | Drill Life (Number of Holes) | Tool Life (min.) |
|---|---|---|---|---|---|
| Low Carbon | 1 | | 135 | 850 | 245 |
| | | 920° C. | | | |
| | 2 | | 130 | 452 | 120 |
| | | × 2 hrs | | | |
| | 3 | | 130 | 2112 | 290 |
| | | A.C. | | | |
| | 4 | | 128 | 1311 | 185 |
| Medium Carbon | 5 | | 200 | 82 | 125 |
| | | 830° C. | | | |
| | 6 | | 205 | 48 | 95 |
| | | × 2 hrs | | | |
| | 7 | | 198 | 155 | 153 |
| | | A.C. | | | |
| | 8 | | 200 | 100 | 105 |
| SCr21 | 9 | | 178 | 180 | 185 |
| | | 900° C. | | | |
| | 10 | | 175 | 102 | 150 |
| | | × 2 hrs | | | |
| | 11 | | 175 | 285 | 200 |
| | | A.C. | | | |
| | 12 | | 170 | 191 | 155 |
| SCM21 | 13 | | 175 | 183 | 170 |
| | | 900° C. | | | |
| | 14 | | 170 | 98 | 130 |
| | | × 2 hrs | | | |
| | 15 | | 175 | 250 | 185 |
| | | A.C. | | | |
| | 16 | | 173 | 170 | 140 |
| SNCM5 | 17 | | 228 | 60 | 110 |
| | | 850° C. | | | |
| | 18 | | 230 | 40 | 95 |
| | | × 2 hrs | | | |
| | 19 | | 230 | 123 | 125 |
| | | A.C. | | | |
| | 20 | | 228 | 60 | 110 |

Table IV clearly shows that, in all the steel marks, the free cutting steels of the present invention, in which the aspect and distribution of the inclusion particles are so regulated as defined above, resulted in 1.5 to 2.0 times longer tool lives both in drilling and turning than those of the control steels, in which the aspect and distribution of the inclusion particles are not regulated.

Further tests of machinability were conducted under the conditions of different cutting speed, feeding speed and cutting depth. The results also proved that the free cutting steel of the present invention has superior machinability to the conventional free cutting steel.

In addition, the present steel containing lead has 1.5 to 2.0 times longer drill life than that of the steel containing no lead. This proves clearly the effect of adding lead on the machinability, particularly drilling property.

EXAMPLE II

In an arc furnace of experimental scale, alloying elements other than Te, Pb, Bi and Ca were melted to give steels of predetermined compositions. The molten steels were received in a vacuum-degassing vessel for beeing degassed, and then poured into a ladle which has a porous plug at the bottom. After addition of predetermined amount of Al, argon gas was blown into the molten steels through the porous plug to agitate it. During the agitation, Te was added to the molten steels in such amount according to the sulfur content of the steels that %Te/%S is 0.04 or higher.

In the case of necessity, Pb, Bi or Ca of a predetermined amount was added in the form of powder through the porous plug on the argon gas stream. Alternatively, Pb, Bi and Ca can be added to the stream of molten steel during the pouring from the degassing vessel to the ladel having porous plug for gas blowing.

Then, the molten steel were cast into 1.3-ton ingots by bottom pouring. These steel can be cast, if desired, by conventional manner of continuous casting.

Table V shows the composition of the steels thus prepared.

The list below shows the steel marks included in this Example and the runs related to each steel mark:

| Steel Mark | Present Invention Run Numbers | Control Examples Run Numbers |
|---|---|---|
| S10C | 1 to 6 | 7 |
| S55C | 8 to 15 | 16, 17 |
| SMn21 | 18 to 22 | 23, 24 |
| SCr4 | 25 to 32 | 33 to 35 |
| SNC2 | 36 to 40 | 41 |

-continued

| Steel Mark | Present Invention Run Numbers | Control Examples Run Numbers |
|---|---|---|
| SNCM25 | 42 to 46 | 47 |
| SCM22 | 48 to 55 | 56, 57 |
| SMnC3 | 58 to 64 | 65, 66 |
| 4032 | 67 to 71 | 72 |
| 4621 | 73 to 77 | 78 |

TABLE V

| Steel Mark | Run | C | Si | Mn | P | S | Te | % Te/% S | O | N | Al | Ni | Cr | Mo | B,V,Ti,Nb, Ta,Zr,REM | Pb,Bi, Se,Ca |
|---|---|---|---|---|---|---|---|---|---|---|---|---|---|---|---|---|
| S10C | | | | | | | | | | | | | | | | |
| | 1 | 0.08 | 0.25 | 1.21 | 0.026 | 0.360 | 0.015 | 0.042 | 0.0015 | 0.012 | 0.025 | — | — | — | — | — |
| | 2 | 0.09 | 0.22 | 1.22 | 0.016 | 0.384 | 0.016 | 0.042 | 0.0014 | 0.015 | 0.007 | — | — | — | Ti:0.09 | — |
| | 3 | 0.12 | 0.24 | 1.25 | 0.027 | 0.356 | 0.018 | 0.051 | 0.0012 | 0.013 | 0.033 | — | — | — | — | Pb:0.18 |
| | 4 | 0.10 | 0.24 | 1.23 | 0.023 | 0.351 | 0.019 | 0.054 | 0.0024 | 0.013 | 0.005 | — | — | — | — | Bi:0.18 |
| | 5 | 0.11 | 0.22 | 1.25 | 0.070 | 0.350 | 0.015 | 0.043 | 0.0013 | 0.012 | 0.032 | — | — | — | Nb:0.08 | Ca:0.0032 |
| | 6 | 0.08 | 0.20 | 1.21 | 0.065 | 0.375 | 0.017 | 0.045 | 0.0012 | 0.013 | 0.040 | — | — | — | Zr:0.16 | Pb:0.06 Ca:0.0076 |
| | 7 | 0.12 | 0.21 | 1.25 | 0.017 | 0.355 | — | — | 0.0104 | 0.010 | 0.005 | — | — | — | — | — |
| S55C | | | | | | | | | | | | | | | | |
| | 8 | 0.56 | 0.24 | 0.81 | 0.021 | 0.054 | 0.003 | 0.056 | 0.0016 | 0.009 | 0.018 | -- | — | — | — | — |
| | 9 | 0.54 | 0.24 | 0.80 | 0.013 | 0.054 | 0.004 | 0.074 | 0.0011 | 0.008 | 0.028 | — | — | — | B:0.003 Ti:0.003 | — |
| | 10 | 0.58 | 0.28 | 0.74 | 0.024 | 0.051 | 0.015 | 0.294 | 0.0012 | 0.009 | 0.015 | — | — | — | Zr:0.04 | — |
| | 11 | 0.57 | 0.25 | 0.85 | 0.029 | 0.045 | 0.008 | 0.178 | 0.0009 | 0.010 | 0.010 | — | — | — | Nb:0.07 Ti:0.01 | — |
| | 12 | 0.57 | 0.28 | 0.83 | 0.010 | 0.051 | 0.009 | 0.176 | 0.0010 | 0.010 | 0.018 | — | — | — | — | Pb:0.06 |
| | 13 | 0.56 | 0.28 | 0.82 | 0.022 | 0.055 | 0.005 | 0.091 | 0.0012 | 0.008 | 0.022 | — | — | — | — | Pb:0.09 Ca:0.0041 |
| | 14 | 0.58 | 0.25 | 0.77 | 0.005 | 0.053 | 0.025 | 0.472 | 0.0014 | 0.008 | 0.023 | — | — | — | Zr:0.08 Ti:0.05 | Se:0.35 |
| | 15 | 0.58 | 0.23 | 0.74 | 0.014 | 0.046 | 0.010 | 0.217 | 0.0011 | 0.010 | 0.014 | — | — | — | Nb:0.05 | Ca:0.0049 |
| | 16 | 0.53 | 0.28 | 0.73 | 0.016 | 0.053 | — | — | 0.0035 | 0.009 | 0.022 | — | — | — | — | — |
| | 17 | 0.56 | 0.27 | 0.78 | 0.012 | 0.053 | — | — | 0.0045 | 0.011 | 0.025 | — | — | — | B:0.0059 Ti:0.03 | — |
| SMn21 | | | | | | | | | | | | | | | | |
| | 18 | 0.21 | 0.27 | 1.25 | 0.015 | 0.154 | 0.007 | 0.045 | 0.0012 | 0.012 | 0.025 | — | — | — | — | — |
| | 19 | 0.19 | 0.29 | 1.28 | 0.014 | 0.144 | 0.009 | 0.063 | 0.0014 | 0.013 | 0.032 | — | — | — | B:0.0019 Ti:0.05 Nb:0.03 | — |
| | 20 | 0.19 | 0.26 | 1.33 | 0.015 | 0.162 | 0.015 | 0.093 | 0.0007 | 0.015 | 0.035 | — | — | — | Ti:0.03 | — |
| | 21 | 0.20 | 0.24 | 1.34 | 0.024 | 0.161 | 0.011 | 0.068 | 0.0016 | 0.012 | 0.028 | — | — | — | — | Pb:0.15 Bi:0.04 |
| | 22 | 0.19 | 0.28 | 1.26 | 0.021 | 0.165 | 0.011 | 0.067 | 0.0017 | 0.013 | 0.049 | — | — | — | V:0.19 Zr:0.15 | Bi:0.09 Se:0.035 |
| | 23 | 0.20 | 0.23 | 1.32 | 0.019 | 0.165 | — | — | 0.025 | 0.013 | 0.035 | — | — | — | — | — |
| | 24 | 0.20 | 0.22 | 1.30 | 0.013 | 0.161 | — | — | 0.045 | 0.025 | 0.033 | — | — | — | B:0.003 Ti:0.06 | — |
| SCr4 | | | | | | | | | | | | | | | | |
| | 25 | 0.40 | 0.22 | 0.78 | 0.018 | 0.064 | 0.011 | 0.172 | 0.0017 | 0.010 | 0.029 | — | 0.96 | — | — | — |
| | 26 | 0.39 | 0.20 | 0.74 | 0.024 | 0.070 | 0.009 | 0.129 | 0.0013 | 0.012 | 0.900 | — | 0.98 | — | B:0.003 Ti:0.04 | — |
| | 27 | 0.42 | 0.28 | 0.75 | 0.008 | 0.075 | 0.003 | 0.040 | 0.0019 | 0.019 | 0.018 | — | 1.05 | — | V:0.15 | — |
| | 28 | 0.41 | 0.28 | 0.70 | 0.019 | 0.074 | 0.018 | 0.243 | 0.0013 | 0.017 | 0.026 | — | 1.01 | — | Nb:0.08 | — |
| | 29 | 0.41 | 0.23 | 0.73 | 0.013 | 0.065 | 0.015 | 0.231 | 0.0012 | 0.014 | 0.022 | — | 0.99 | — | — | Pb:0.19 |
| | 30 | 0.40 | 0.22 | 0.74 | 0.028 | 0.068 | 0.028 | 0.412 | 0.0020 | 0.012 | 0.034 | — | 0.97 | — | — | Se:0.224 |
| | 31 | 0.41 | 0.22 | 0.72 | 0.022 | 0.063 | 0.005 | 0.079 | 0.0018 | 0.011 | 1.100 | — | 1.05 | — | — | Bi:0.02 Ca:0.0096 |
| | 32 | 0.39 | 0.24 | 0.71 | 0.024 | 0.067 | 0.008 | 0.119 | 0.0015 | 0.012 | 0.021 | — | 1.00 | — | B:0.003 Ti:0.05 | Ca:0.0033 |
| | 33 | 0.40 | 0.23 | 0.74 | 0.026 | 0.075 | — | — | 0.0050 | 0.011 | 0.008 | — | 0.98 | — | — | — |
| | 34 | 0.39 | 0.28 | 0.75 | 0.023 | 0.080 | — | — | 0.0045 | 0.012 | 0.065 | — | 1.04 | — | B:0.0034 Ti:0.04 | — |
| | 35 | 0.41 | 0.21 | 0.76 | 0.005 | 0.074 | 0.001 | 0.014 | 0.0038 | 0.010 | 0.023 | — | 1.00 | — | V:0.14 | Pb:0.04 |
| SNC2 | | | | | | | | | | | | | | | | |
| | 36 | 0.30 | 0.27 | 0.48 | 0.022 | 0.053 | 0.005 | 0.094 | 0.0018 | 0.010 | 0.019 | 2.69 | 0.79 | — | — | — |
| | 37 | 0.30 | 0.27 | 0.48 | 0.010 | 0.052 | 0.008 | 0.154 | 0.0018 | 0.011 | 0.020 | 2.77 | 0.80 | — | B:0.0089 | — |
| | 38 | 0.30 | 0.27 | 0.45 | 0.020 | 0.058 | 0.004 | 0.069 | 0.0007 | 0.010 | 0.025 | 2.66 | 0.76 | — | Nb:0.06 Zr:0.15 | — |
| | 39 | 0.32 | 0.24 | 0.49 | 0.028 | 0.055 | 0.013 | 0.236 | 0.0017 | 0.010 | 0.021 | 2.72 | 0.74 | — | — | Pb:0.05 Se:0.083 Ca:0.006 |
| | 40 | 0.31 | 0.21 | 0.46 | 0.022 | 0.058 | 0.012 | 0.207 | 0.0008 | 0.011 | 0.023 | 2.79 | 0.81 | — | Ti:0.05 | Bi:0.06 |
| | 41 | 0.29 | 0.20 | 0.41 | 0.011 | 0.060 | — | — | 0.0025 | 0.011 | 0.022 | 2.71 | 0.85 | — | — | — |
| SNCM25 | | | | | | | | | | | | | | | | |
| | 42 | 0.16 | 0.22 | 0.49 | 0.006 | 0.053 | 0.004 | 0.075 | 0.0013 | 0.012 | 0.025 | 4.20 | 0.88 | 0.17 | — | — |
| | 43 | 0.17 | 0.26 | 0.44 | 0.022 | 0.046 | 0.002 | 0.044 | 0.0012 | 0.012 | 0.023 | 4.18 | 0.81 | 0.16 | V:0.04 Zr:0.03 | — |

TABLE V-continued

| Steel Mark | Run | C | Si | Mn | P | S | Te | % Te/ % S | O | N | Al | Ni | Cr | Mo | B,V,Ti,Nb, Ta,Zr,REM | Pb,Bi, Se,Ca |
|---|---|---|---|---|---|---|---|---|---|---|---|---|---|---|---|---|
| | 44 | 0.17 | 0.21 | 0.46 | 0.020 | 0.040 | 0.005 | 0.125 | 0.0021 | 0.010 | 0.028 | 4.33 | 0.80 | 0.18 | Ni:0.05 Ti:0.02 Zr:0.03 | — |
| | 45 | 0.16 | 0.22 | 0.48 | 0.014 | 0.054 | 0.018 | 0.333 | 0.0010 | 0.012 | 0.024 | 4.19 | 0.83 | 0.18 | — | Pb:0.07 Se:0.125 Ca:0.0077 |
| | 46 | 0.15 | 0.20 | 0.48 | 0.028 | 0.046 | 0.024 | 0.525 | 0.0019 | 0.011 | 0.045 | 4.25 | 0.85 | 0.15 | B:0.004 Ti:0.05 Nb:0.04 | Bi:0.10 |
| | 47 | 0.18 | 0.23 | 0.49 | 0.007 | 0.050 | — | — | 0.0044 | 0.012 | 0.024 | 4.24 | 0.80 | 0.18 | — | — |
| SCM22 | | | | | | | | | | | | | | | | |
| | 48 | 0.20 | 0.23 | 0.76 | 0.014 | 0.046 | 0.011 | 0.239 | 0.0012 | 0.012 | 0.034 | — | 0.96 | 0.17 | — | — |
| | 49 | 0.20 | 0.29 | 0.70 | 0.020 | 0.060 | 0.007 | 0.117 | 0.0012 | 0.010 | 0.035 | — | 1.01 | 0.18 | V:0.05 | — |
| | 50 | 0.19 | 0.23 | 0.72 | 0.023 | 0.047 | 0.009 | 0.191 | 0.0009 | 0.017 | 0.042 | — | 1.04 | 0.15 | Nb:0.05 | — |
| | 51 | 0.20 | 0.28 | 0.76 | 0.019 | 0.050 | 0.014 | 0.280 | 0.0016 | 0.012 | 0.036 | — | 0.98 | 0.15 | — | Pb:0.15 |
| | 52 | 0.19 | 0.23 | 0.72 | 0.011 | 0.049 | 0.013 | 0.265 | 0.0012 | 0.010 | 0.039 | — | 0.99 | 0.18 | — | Pb:0.05 Ca:0.0021 |
| | 53 | 0.19 | 0.24 | 0.71 | 0.006 | 0.059 | 0.003 | 0.051 | 0.0010 | 0.011 | 0.040 | — | 1.05 | 0.17 | — | Ca:0.005 |
| | 54 | 0.19 | 0.27 | 0.73 | 0.008 | 0.058 | 0.005 | 0.086 | 0.0016 | 0.015 | 0.038 | — | 1.02 | 0.15 | Nb:0.04 | Ca:0.0038 |
| | 55 | 0.20 | 0.23 | 0.76 | 0.005 | 0.049 | 0.006 | 0.122 | 0.0017 | 0.014 | 0.035 | — | 0.96 | 0.16 | Nb:0.04 | Se:0.259 Ca:0.0094 |
| | 56 | 0.20 | 0.23 | 0.73 | 0.026 | 0.050 | — | — | 0.0058 | 0.015 | 0.030 | — | 0.99 | 0.16 | — | — |
| | 57 | 0.20 | 0.25 | 0.71 | 0.011 | 0.057 | — | — | 0.0105 | 0.012 | 0.005 | — | 1.03 | 0.18 | Nb:0.05 | Ca:0.0014 |
| SMnC3 | | | | | | | | | | | | | | | | |
| | 58 | 0.42 | 0.25 | 1.40 | 0.018 | 0.094 | 0.006 | 0.064 | 0.0011 | 0.011 | 0.035 | — | 0.46 | — | — | — |
| | 59 | 0.43 | 0.27 | 1.44 | 0.026 | 0.096 | 0.008 | 0.084 | 0.0018 | 0.009 | 0.036 | — | 0.55 | — | B:0.001 Ti:0.04 V:0.06 | — |
| | 60 | 0.43 | 0.27 | 1.46 | 0.012 | 0.101 | 0.009 | 0.089 | 0.0012 | 0.011 | 0.038 | — | 0.51 | — | Nb:0.05 Ti:0.09 | — |
| | 61 | 0.42 | 0.26 | 1.46 | 0.025 | 0.094 | 0.015 | 0.160 | 0.0013 | 0.012 | 0.042 | — | 0.49 | | — | Ca:0.0053 |
| | 62 | 0.44 | 0.27 | 1.48 | 0.015 | 0.096 | 0.013 | 0.135 | 0.0009 | 0.010 | 0.041 | — | 0.45 | | — | Bi:0.03 Ca:0.0038 |
| | 63 | 0.43 | 0.25 | 1.40 | 0.025 | 0.094 | 0.004 | 0.043 | 0.0016 | 0.012 | 0.035 | — | 0.53 | — | Nb:0.04 | Pb:0.03 Bi:0.07 |
| | 64 | 0.43 | 0.21 | 1.46 | 0.007 | 0.108 | 0.017 | 0.157 | 0.0018 | 0.011 | 0.037 | — | 0.51 | — | Ti:0.03 Zr:0.15 | Se:0.065 |
| | 65 | 0.42 | 0.20 | 1.44 | 0.023 | 0.102 | — | — | 0.0043 | 0.012 | 0.034 | — | 0.44 | — | — | — |
| | 66 | 0.44 | 0.23 | 1.45 | 0.015 | 0.106 | — | — | 0.0052 | 0.010 | 0.025 | — | 0.51 | — | B:0.0022 Ti:0.05 | — |
| 4032 | | | | | | | | | | | | | | | | |
| | 67 | 0.31 | 0.29 | 0.81 | 0.018 | 0.075 | 0.009 | 0.12 | 0.0015 | 0.011 | 0.042 | — | — | 0.25 | — | — |
| | 68 | 0.31 | 0.22 | 0.80 | 0.021 | 0.087 | 0.004 | 0.046 | 0.0009 | 0.011 | 0.045 | — | — | 0.24 | V:0.01 — Ti:0.05 | |
| | 69 | 0.32 | 0.22 | 0.85 | 0.025 | 0.083 | 0.008 | 0.096 | 0.0017 | 0.012 | 0.040 | — | — | 0.27 | Zr:0.12 | — |
| | 70 | 0.33 | 0.22 | 0.87 | 0.024 | 0.078 | 0.018 | 0.231 | 0.0028 | 0.009 | 0.025 | — | — | 0.27 | — | Pb:0.05 Bi:0.01 Ca:0.0029 |
| | 71 | 0.31 | 0.26 | 0.83 | 0.010 | 0.084 | 0.014 | 0.167 | 0.0023 | 0.007 | 0.041 | — | — | 0.24 | Nb:0.05 | Pb:0.18 |
| | 72 | 0.31 | 0.25 | 0.82 | 0.007 | 0.089 | — | — | 0.0064 | 0.009 | 0.040 | — | — | 0.26 | — | — |
| 4621 | | | | | | | | | | | | | | | | |
| | 73 | 0.21 | 0.28 | 0.88 | 0.014 | 0.045 | 0.012 | 0.267 | 0.0018 | 0.012 | 0.041 | 1.77 | — | 0.26 | — | — |
| | 74 | 0.20 | 0.20 | 0.82 | 0.011 | 0.047 | 0.010 | 0.213 | 0.0011 | 0.012 | 0.045 | 1.81 | — | 0.26 | B:0.0042 Ti:0.04 Zr:0.01 | — |
| | 75 | 0.21 | 0.26 | 0.85 | 0.012 | 0.054 | 0.009 | 0.167 | 0.0010 | 0.012 | 0.019 | 1.83 | — | 0.27 | — | Pb:0.08 Ca:0.0021 |
| | 76 | 0.22 | 0.22 | 0.80 | 0.015 | 0.045 | 0.007 | 0.156 | 0.0020 | 0.013 | 0.016 | 1.75 | — | 0.24 | — | Ca:0.0058 |
| | 77 | 0.20 | 0.29 | 0.82 | 0.023 | 0.048 | 0.008 | 0.167 | 0.0012 | 0.012 | 0.015 | 1.77 | — | 0.25 | Zr:0.10 | Bi:0.05 Ca:0.0042 |
| | 78 | 0.20 | 0.27 | 0.83 | 0.022 | 0.050 | — | — | 0.0048 | 0.001 | 0.038 | 1.85 | — | 0.27 | — | — |

The ingots were hot rolled at a finishing temperature of 950° C. and with a forging ratio of about 100 or more. From the rolled material, specimens were taken for inspection of aspect of sulfide inclusion particles and the content of alumina cluster therein.

(1) Aspect of sulfide inclusion particles

In a definite field of microscope observation was made on the sulfide particles which are 10μ or more long to measure those length(L) and width(W), and calculation was made to determine the percentage of the number of not elongated particles which has the aspect ratio L/W not larger than 5 among the measured particles. The results are shown in Table VI. According to the Table the percentage was less than 20 in all the control steels, while the percentage was more than 80 in all the steels of the present invention. It was concluded that the sulfide inclusion particles in the present steels are not in an elongated form.

(2) Content of alumina cluster

Specimens of 20 mm long and 15 mm wide were subjected to microscopic inspection according to the method defined in JIS G o555 to determine the areal percentage of alumina cluster in the matrix cross section. The results are also given in Table VI. The Table clearly shows that the present steels have much lower areal percentages of alumina cluster than the control steels. The better cleanliness is considered to show the effect of lower oxygen content.

In table VI "L/W≦5 (%)" means the number of percentage of the sulfide inclusion particles having L/W not larger than 5, and "Alumina (%)" means the areal percentage of alumina cluster.

TABLE VI

| Steel Mark | Run | L/W ≦ 5 (%) | Alumina (%) | Steel Mark | Run | L/W ≦ 5 (%) | Alumina (%) |
|---|---|---|---|---|---|---|---|
| S10C | | | | SMn21 | | | |
| | 1 | 82 | 0.04 | | 21 | 86 | 0.06 |
| | 2 | 85 | 0.03 | | 22 | 92 | 0.07 |
| | 3 | 84 | 0.05 | | 23 | 21 | 0.89 |
| | 4 | 89 | 0.01 | | 24 | 18 | 0.87 |
| | 5 | 83 | 0.06 | SCr4 | | | |
| | 6 | 91 | 0.03 | | 25 | 90 | 0.04 |
| | 7 | 14 | 0.82 | | 26 | 90 | 0.02 |
| S55C | | | | | 27 | 85 | 0.02 |
| | 8 | 98 | 0.06 | | 28 | 96 | 0.03 |
| | 9 | 95 | 0.07 | | 29 | 97 | 0.01 |
| | 10 | 97 | 0.04 | | 30 | 91 | 0.08 |
| | 11 | 99 | 0.03 | | 31 | 91 | 0.01 |
| | 12 | 94 | 0.02 | | 32 | 89 | 0.04 |
| | 13 | 92 | 0.02 | | 33 | 13 | 0.86 |
| | 14 | 90 | 0.03 | | 34 | 15 | 0.84 |
| | 15 | 95 | 0.02 | | 35 | 22 | 0.52 |
| | 16 | 19 | 0.85 | SNC2 | | | |
| | 17 | 16 | 0.54 | | 36 | 89 | 0.01 |
| SMn21 | | | | | 37 | 94 | 0.04 |
| | 18 | 87 | 0.03 | | 38 | 93 | 0.04 |
| | 19 | 88 | 0.04 | | 39 | 93 | 0.02 |
| | 20 | 88 | 0.01 | | 40 | 97 | 0.08 |
| | | | | | 41 | 18 | 0.86 |
| SNCM25 | | | | SMnC3 | | | |
| | 42 | 90 | 0.05 | | 62 | 87 | 0.08 |
| | 43 | 91 | 0.02 | | 63 | 87 | 0.09 |
| | 44 | 88 | 0.07 | | 64 | 91 | 0.01 |
| | 45 | 96 | 0.02 | | 65 | 20 | 0.82 |
| | 46 | 94 | 0.05 | | 66 | 18 | 0.83 |
| | 47 | 25 | 0.87 | 4032 | | | |
| SCM22 | | | | | 67 | 86 | 0.04 |
| | 48 | 92 | 0.06 | | 68 | 84 | 0.08 |
| | 49 | 81 | 0.06 | | 69 | 85 | 0.08 |
| | 50 | 96 | 0.02 | | 70 | 90 | 0.02 |
| | 51 | 93 | 0.04 | | 71 | 90 | 0.02 |
| | 52 | 92 | 0.06 | | 72 | 16 | 0.85 |
| | 53 | 92 | 0.05 | 4621 | | | |
| | 54 | 89 | 0.06 | | 73 | 95 | 0.07 |
| | 55 | 90 | 0.01 | | 74 | 97 | 0.03 |
| | 56 | 21 | 0.83 | | 75 | 87 | 0.06 |
| | 57 | 15 | 0.96 | | 76 | 87 | 0.07 |
| SMnC3 | | | | | 77 | 90 | 0.04 |
| | 58 | 94 | 0.02 | | 78 | 18 | 0.85 |
| | 59 | 85 | 0.05 | | | | |
| | 60 | 89 | 0.04 | | | | |
| | 61 | 87 | 0.01 | | | | |

The steels of Table V were heat treated under suitable conditions, and subjected to measurement of rolling-contact fatigue strength. The measurement was made on the specimens of 22 mm long and 12 mm diameter, by counting $B_{10}$-Life (number of repeated rolling until 10% of the whole number brake) and $B_{50}$-Life (number of repeated rolling until 50% of the whole number brake) under the testing condition given below:

Testing condition for rolling-contact fatigue strength

Herz stress: 300 to 600 kg/mm$^2$
Number of rotation: 23,120 r.p.m.
Lubricant: Turbine oil #140
Number of repetition: 10

Table VII shows the results of the above test and the conditions of the above mentioned heat treatment. The Table clearly indicates remarkable improvement in rolling fatigue strength of the present steels in comparison with the control steels.

TABLE VII

| Steel Mark | Run | Heat Treatment | Rolling Fatigue Strength: Surface Pressure kg/mm$^2$ | $B_{10}$-Life ($\times 10^6$) | $B_{50}$-Life ($\times 10^6$) |
|---|---|---|---|---|---|
| S10C | | | | | |
| | 1 | | 400 | 2.2 | 9.8 |
| | | Carburizing | | | |
| | 2 | | 400 | 1.8 | 8.6 |
| | | 900° C. | | | |
| | 3 | | 400 | 1.2 | 4.5 |
| | | Hardening | | | |
| | 4 | | 400 | 1.2 | 4.2 |
| | | 830° C., W.Q. | | | |
| | 5 | | 400 | 2.0 | 8.8 |
| | | Tempering | | | |
| | 6 | | 400 | 1.6 | 5.0 |
| | | 200° C., A.C. | | | |
| | 7 | | 400 | 0.3 | 1.0 |
| S55C | | | | | |
| | 8 | | 600 | 1.5 | 3.4 |
| | | High | | | |
| | 9 | Frequency | 600 | 1.6 | 3.5 |
| | | Hardening | | | |
| | 10 | | 600 | 1.8 | 3.8 |
| | | 830° C., W.Q. | | | |
| | 11 | | 600 | 1.5 | 3.5 |
| | | Tempering | | | |
| | 12 | | 600 | 0.9 | 2.0 |
| | | 200° C., A.C. | | | |
| | 13 | | 600 | 0.8 | 2.0 |
| | 14 | | 600 | 1.3 | 3.0 |
| | 15 | | 600 | 1.3 | 3.1 |
| | 16 | | 600 | 0.2 | 0.6 |
| | 17 | | 600 | 0.2 | 0.5 |

| Steel Mark | Run | Heat Treatment | Rolling-Contact/Fatigue Strength: Surface Pressure kg/mm$^2$ | $B_{10}$-Life ($\times 10^6$) | $B_{50}$-Life ($\times 10^6$) |
|---|---|---|---|---|---|
| SMn21 | | | | | |
| | 18 | | 600 | 3.0 | 10.0 |
| | | Carburaizing | | | |
| | 19 | | 600 | 3.2 | 11.5 |
| | | 900° C. | | | |
| | 20 | | 600 | 3.0 | 10.0 |
| | | Hardening | | | |
| | 21 | | 600 | 1.5 | 6.2 |
| | | 830° C., O.Q. | | | |
| | 22 | | 600 | 1.6 | 5.8 |
| | | Tempering | | | |
| | 23 | | 600 | 0.5 | 2.4 |
| | | 200° C., A.C. | | | |
| | 24 | | 600 | 0.4 | 2.3 |
| SCr4 | | | | | |
| | 25 | | 350 | 13 | 44 |
| | 26 | | 350 | 16 | 51 |
| | 27 | | 350 | 20 | 58 |
| | | Hardening | | | |
| | 28 | | 350 | 14 | 46 |
| | | 850° C., O.Q. | | | |
| | 29 | | 350 | 7.1 | 25 |
| | 30 | | 350 | 7.5 | 28 |
| | | Tempering | | | |
| | 31 | | 350 | 9.8 | 37 |
| | | 450° C., A.C. | | | |
| | 32 | | 350 | 19 | 55 |
| | 33 | | 350 | 2.0 | 5.1 |
| | 34 | | 350 | 2.5 | 5.2 |
| | 35 | | 350 | 1.6 | 3.5 |
| SNC2 | | | | | |
| | 36 | | 350 | 11 | 45 |
| | | Hardening | | | |
| | 37 | | 350 | 12 | 45 |
| | | 850° C., O.Q. | | | |
| | 38 | | 350 | 14 | 51 |
| | 39 | | 350 | 8.3 | 33 |
| | | Tempering | | | |
| | 40 | | 350 | 15 | 60 |
| | | 400° C., W.Q. | | | |
| | 41 | | 350 | 0.9 | 2.6 |
| SNCM25 | | | | | |

TABLE VII-continued

| | | | | | |
|---|---|---|---|---|---|
| | 42 | Carburizing | 600 | 14 | 44 |
| | 43 | 900° C. | 600 | 18 | 42 |
| | 44 | Hardening | 600 | 10 | 36 |
| | 45 | 830° C., O.Q. | 600 | 9.5 | 25 |
| | 46 | Tempering | 600 | 9.6 | 26 |
| | 47 | 190° C., A.C. | 600 | 3.4 | 10 |
| SCM22 | | | | | |
| | 48 | | 600 | 16 | 40 |
| | 49 | | 600 | 15 | 39 |
| | 50 | Carburizing | 600 | 19 | 44 |
| | 51 | 900° C. | 600 | 10 | 30 |
| | 52 | Hardening | 600 | 11 | 29 |
| | 53 | 830° C., O.Q. | 600 | 19 | 50 |
| | 54 | Tempering | 600 | 18 | 46 |
| | 55 | 190° C., A.C. | 600 | 12 | 39 |
| | 56 | | 600 | 3.3 | 8.1 |
| | 57 | | 600 | 4.5 | 9.8 |
| SMnC3 | | | | | |
| | 58 | | 350 | 20 | 73 |
| | 59 | | 350 | 22 | 74 |
| | 60 | | 350 | 27 | 81 |
| | | Hardening | | | |
| | 61 | | 350 | 27 | 80 |
| | | 850° C., O.C. | | | |
| | 62 | | 350 | 18 | 68 |
| | | Tempering | | | |
| | 63 | | 350 | 16 | 66 |
| | | 400° C., A.C. | | | |
| | 64 | | 350 | 17 | 69 |
| | 65 | | 350 | 4.0 | 12.8 |
| | 66 | | 350 | 3.9 | 13.0 |
| 4032 | | | | | |
| | 67 | | 350 | 5.1 | 16 |
| | 68 | Hardening | 350 | 5.7 | 17 |
| | 69 | 830° C., O.Q. | 350 | 5.6 | 17 |
| | 70 | Tempering | 350 | 4.0 | 15 |
| | 71 | 300° C., W.Q. | 350 | 3.3 | 15 |
| | 72 | | 350 | 0.8 | 3.9 |
| 4621 | | | | | |
| | 73 | Carburizing | 600 | 8.2 | 29 |
| | 74 | 900° C. | 600 | 8.9 | 26 |
| | 75 | Hardening | 600 | 5.3 | 11 |
| | 76 | 830° C., O.Q. | 600 | 10.1 | 35 |
| | 77 | Tempering | 600 | 8.0 | 19 |
| | 78 | 150° C., A.C. | 600 | 1.4 | 3.9 |

In order to determine machinability of the steels of Table V, the specimens were, after the heat treatment suitable for each steel mark, machined under the following conditions.

Tool life test with HSS twist drill

Drill: SKH 9, straight shank drill, diameter 10 mm
Feed: 0.42 mm/rev.
Driiling Speed: 30 m/min.
Depth of Hole: 20 mm (blind hole)
Cutting Oil: none
Criterion of Life: Total depth of holes until the drill cuts no longer Tool life test with carbide single point tool Tool: P 10 (−5, −5, 5, 5, 30, 0, 0.4)
Feed: 0.2 mm/rev.
Cutting Speed: 200 m/min.
Depth of Cutting: 2.0 mm
Cutting Oil: none
Criterion of Life: Total length of time until $V_B=0.2$
The results are shown in Table VIII.

TABLE VIII

| Steel Mark | Run | Heat Treatment | Drill Life (mm) | Tool Life (mm) |
|---|---|---|---|---|
| S10C | | | | |
| | 1 | | 6,920 | 58 |
| | 2 | | 6,760 | 60 |

TABLE VIII-continued

| Steel Mark | Run | Heat Treatment | Drill Life (mm) | Tool Life (mm) |
|---|---|---|---|---|
| | 3 | | 19,240 | 65 |
| | | Normalizing | | |
| | 4 | | 21,080 | 64 |
| | | 900° C., A.C. | | |
| | 5 | | 7,240 | 121 |
| | 6 | | 10,500 | 134 |
| | 7 | | 5,400 | 41 |
| S55C | | | | |
| | 8 | | 280 | 17 |
| | 9 | | 240 | 15 |
| | 10 | | 220 | 15 |
| | 11 | | 220 | 16 |
| | 12 | Annealing | 680 | 18 |
| | 13 | 850° C., F.C. | 1,240 | 35 |
| | 14 | | 2,160 | 20 |
| | 15 | | 320 | 32 |
| | 16 | | 200 | 12 |
| | 17 | | 160 | 12 |
| SMn21 | | | | |
| | 18 | | 520 | 21 |
| | 19 | | 460 | 20 |
| | 20 | | 480 | 21 |
| | | Normalizing | | |
| | 21 | | 2,100 | 25 |
| | | 850° C., A.C. | | |
| | 22 | | 1,820 | 28 |
| | 23 | | 340 | 16 |
| | 24 | | 300 | 14 |
| SCr4 | | | | |
| | 25 | | 480 | 24 |
| | 26 | | 480 | 22 |
| | 27 | | 420 | 20 |
| | 28 | | 460 | 21 |
| | 29 | | 1,280 | 25 |
| | | Annealing | | |
| | 30 | | 1,320 | 31 |
| | | 850° C., F.C. | | |
| | 31 | | 560 | 64 |
| | 32 | | 500 | 60 |
| | 33 | | 360 | 18 |
| | 34 | | 320 | 16 |
| | 35 | | 420 | 15 |
| SNC2 | | | | |
| | 36 | | 260 | 16 |
| | 37 | | 240 | 15 |
| | 38 | Annealing | 240 | 15 |
| | 39 | 850° C., F.C. | 880 | 18 |
| | 40 | | 600 | 17 |
| | 41 | | 200 | 13 |
| SNCM25 | | | | |
| | 42 | | 400 | 22 |
| | 43 | | 380 | 20 |
| | 44 | Normalizing | 400 | 20 |
| | 45 | 900° C., A.C. | 2,160 | 64 |
| | 46 | | 1,880 | 24 |
| | 47 | | 280 | 17 |
| SCM22 | | | | |
| | 48 | | 700 | 40 |
| | 49 | | 680 | 41 |
| | 50 | | 720 | 41 |
| | 51 | | 1,800 | 45 |
| | | Normalizing | | |
| | 52 | | 1,680 | 74 |
| | | 900° C., A.C. | | |
| | 53 | | 700 | 72 |
| | 54 | | 740 | 70 |
| | 55 | | 2,120 | 86 |
| | 56 | | 500 | 34 |
| | 57 | | 500 | 40 |
| SMnC3 | | | | |
| | 58 | | 220 | 10 |
| | 59 | | 200 | 10 |
| | 60 | | 200 | 9 |
| | 61 | | 220 | 29 |
| | | Annealing | | |
| | 62 | | 340 | 34 |
| | | 850° C., F.C. | | |
| | 63 | | 660 | 15 |
| | 64 | | 480 | 13 |
| | 65 | | 140 | 6 |

TABLE VIII-continued

| Steel Mark | Run | Heat Treatment | Drill Life (mm) | Tool Life (mm) |
|---|---|---|---|---|
| | 66 | | 120 | 6 |
| 4032 | | | | |
| | 67 | | 180 | 6 |
| | 68 | | 160 | 5 |
| | 69 | Annealing | 160 | 5 |
| | 70 | 830° C., F.C. | 320 | 18 |
| | 71 | | 480 | 7 |
| | 72 | | 110 | 4 |
| 4621 | | | | |
| | 73 | | 460 | 25 |
| | 74 | | 420 | 24 |
| | 75 | Annealing | 760 | 68 |
| | 76 | 830° C., F.C. | 460 | 70 |
| | 77 | | 680 | 69 |
| | 78 | | 320 | 21 |

We claim:

1. A free cutting steel for machine structural use having excellent machinability comprising:
C up to 0.6%,
Si up to 2.0%,
Mn up to 2.0%,
S 0.04 to 0.4%,
Te 0.002 to 0.50%, and
O 0.0010 to 0.0300%,
the balance being substantially Fe;
and containing MnS-based inclusion in the form of particles of 5 to 100μ long, 1 to 10μ wide, wherein the aspect ratio defined by length/width is not larger than 10, and at a density of 20 to 200 particles per 1 $mm^2$ of matrix cross section.

2. A free cutting steel according to claim 1, which further contains P up to 0.10%.

3. A free cutting steel according to claim 1, which further contains Pb 0.03 to 0.30%.

4. A free cutting steel according to claim 1, which further contains one or more of Ni up to 4.5%, Cr up to 4.5% and Mo up to 1.0%.

5. A method of making a free cutting steel for machine structural use having excellent machinability, which comprises hot rolling an ingot of a steel containing:
C up to 0.6%,
Si up to 2.0%,
Mn up to 2.0%,
S 0.04 to 0.4%,
Te 0.002 to 0.50%, and
O 0.0010 to 0.0300%,
the balance being substantially Fe,
under the condition of soaking temperature between 1,200° and 1,400° C., and a finishing temperature above 1,000° C.

6. A free cutting steel for machine structural use having improved rolling-contact fatigue strength comprising:
C up to 0.6%,
Si up to 2.0%,
Mn up to 2.0%,
S 0.04 to 0.4% and Te up to 0.1%,
wherein the ratio %Te/%S is at least 0.04,
O up to 0.0030%, and
N up to 0.0200%,
the balance being substantially Fe;
characterized in that at least 80% of sulfide-based inclusion particles of 10μ long or more have the aspect ratio defined by length/width of 5 or less, and that the areal percentage of alumina cluster in the matrix cross section is not higher than 0.5%.

7. A free cutting steel according to claim 6, which further contains one or more of the alloying elements selected from:
P up to 0.1%,
Pb up to 0.3%,
Bi up to 0.3%, provided that Pb+Bi is not larger than 0.4%,
Se up to 0.4%, provided that S+Se is not larger than 0.4%, and
Ca up to 0.0100%.

8. A free cutting steel according to claim 6, which further contains one or more of the alloying elements selected from:
Ni up to 6.0%,
Cr up to 4.0%,
Mo up to 2.0%,
Al up to 2.0%,
B up to 0.010%,
V up to 0.5%,
Ti up to 0.5%,
Nb up to 0.5%,
Ta up to 0.5%, Zr up to 0.5%, and
REM (rare earth metals) up to 0.1% in total.

9. A free cutting steel according to claim 6, which further contains one or more of the alloying elements selected from:
Ni up to 6.0%,
Cr up to 4.0%,
Mo up to 2.0%,
Al up to 2.0%,
B up to 0.010%,
V up to 0.5%,
Ti up to 0.5%,
Nb up to 0.5%,
Ta up to 0.5%
Zr up to 0.5%, and
REM up to 0.1% in total,
together with one or more of the alloying elements selected from:
P up to 0.1%,
Pb up to 0.3%,
Bi up to 0.3%, provided that Pb+Bi is not larger than 0.4%,
Se up to 0.4%, provided that S+Se is not larger than 0.4%, and Ca up to 0.0100%.

* * * * *